US010519781B2

(12) United States Patent
Spangler

(10) Patent No.: US 10,519,781 B2
(45) Date of Patent: Dec. 31, 2019

(54) AIRFOIL TURN CAPS IN GAS TURBINE ENGINES

(71) Applicant: United Technologies Corporation, Farmington, CT (US)

(72) Inventor: Brandon W. Spangler, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 473 days.

(21) Appl. No.: 15/404,252

(22) Filed: Jan. 12, 2017

(65) Prior Publication Data

US 2018/0195397 A1 Jul. 12, 2018

(51) Int. Cl.

| | |
|---|---|
| ***F01D 5/18*** | (2006.01) |
| ***F01D 9/04*** | (2006.01) |
| ***F01D 25/12*** | (2006.01) |

(52) U.S. Cl.

CPC ..... *F01D 5/187* (2013.01); *F01D 9/041* (2013.01); *F01D 25/12* (2013.01); *F05D 2220/32* (2013.01); *F05D 2230/237* (2013.01); *F05D 2260/20* (2013.01)

(58) Field of Classification Search

CPC ..... F01D 5/147; F01D 5/186; F01D 5/187; F01D 9/041; F01D 25/12; F05D 2220/32; F05D 2230/237; F05D 2240/81; F05D 2240/125; F05D 2260/20

See application file for complete search history.

(56) References Cited

U.S. PATENT DOCUMENTS

| | | | |
|---|---|---|---|
| 4,257,737 | A | 3/1981 | Andress et al. |
| 4,411,597 | A | 10/1983 | Koffel et al. |
| 5,393,198 | A | 2/1995 | Noda et al. |

(Continued)

FOREIGN PATENT DOCUMENTS

| | | | |
|---|---|---|---|
| EP | 0735240 | A1 | 10/1996 |
| EP | 3106621 | A2 | 12/2016 |

(Continued)

OTHER PUBLICATIONS

European Search Report, European Application No. 17200998.7, dated May 25, 2018, European Patent Office; European Search Report 7 pages.

*Primary Examiner* — Hieu T Vo
*Assistant Examiner* — Arnold Castro
(74) *Attorney, Agent, or Firm* — Cantor Colburn LLP

(57) ABSTRACT

Airfoils having hollow bodies defining first and second airfoil cavities and having inner and outer diameter ends, a first airfoil platform at one end of the hollow body having a gaspath surface and a non-gaspath surface, wherein the hollow body extends from the gaspath surface. A first cavity opening is formed in the non-gaspath surface of the platform to fluidly connect to the first airfoil cavity and a second cavity opening in the platform is fluidly connected to the second airfoil cavity. A first turn cap is fixedly attached to the first airfoil platform on the non-gaspath surface covering the first and second cavity openings of the first airfoil platform and defines a first turning cavity such that the first cavity opening in the first airfoil platform is fluidly connected to the second cavity opening in the first airfoil platform by the first turning cavity.

20 Claims, 6 Drawing Sheets

(56) References Cited

U.S. PATENT DOCUMENTS

| | | | |
|---|---|---|---|
| 5,511,309 | A | 4/1996 | Beabout |
| 5,525,038 | A | 6/1996 | Sharma et al. |
| 6,126,394 | A | 10/2000 | Matsuda |
| 6,299,412 | B1 | 10/2001 | Wood et al. |
| 7,785,072 | B1 | 8/2010 | Liang et al. |
| 8,192,153 | B2 | 6/2012 | Harvey et al. |
| 8,202,054 | B2 | 6/2012 | Liang |
| 8,292,582 | B1 | 10/2012 | Liang |
| 8,511,999 | B1 | 8/2013 | Kimmel et al. |
| 8,562,295 | B1 | 10/2013 | Liang |
| 8,602,741 | B2 | 12/2013 | Ahmad et al. |
| 8,678,766 | B1 | 3/2014 | Liang |
| 8,821,111 | B2 | 9/2014 | Gear et al. |
| 8,864,438 | B1 | 10/2014 | Lee et al. |
| 8,870,524 | B1 | 10/2014 | Liang |
| 9,550,267 | B2 | 1/2017 | Beckman et al. |
| 9,631,499 | B2 | 4/2017 | Liang |
| 2005/0276698 | A1 | 12/2005 | Kvasnak et al. |
| 2006/0222495 | A1 | 10/2006 | Liang |
| 2007/0258825 | A1 | 11/2007 | Shadbolt et al. |
| 2009/0068023 | A1 | 3/2009 | Liang |
| 2009/0148287 | A1 | 6/2009 | Suciu et al. |
| 2009/0324423 | A1 | 12/2009 | Liang |
| 2010/0054915 | A1 | 3/2010 | Devore et al. |
| 2010/0226789 | A1 | 9/2010 | Liang |
| 2011/0058949 | A1 | 3/2011 | Marra |
| 2014/0050893 | A1 | 2/2014 | Paige et al. |
| 2014/0083116 | A1 | 3/2014 | Crites et al. |
| 2014/0169962 | A1 | 6/2014 | Lee |
| 2016/0069184 | A1 | 3/2016 | Ribic et al. |
| 2016/0312632 | A1 | 10/2016 | Hagan et al. |
| 2016/0376897 | A1 | 12/2016 | Spangler |
| 2018/0195397 | A1* | 7/2018 | Spangler ..... F01D 5/187 |
| 2018/0223676 | A1 | 8/2018 | Spangler et al. |
| 2018/0306036 | A1 | 10/2018 | Spangler et al. |
| 2018/0320531 | A1 | 11/2018 | Spangler et al. |

FOREIGN PATENT DOCUMENTS

| | | | |
|---|---|---|---|
| EP | 3109405 | A1 | 12/2016 |
| EP | 3128130 | A1 | 2/2017 |
| EP | 3184738 | A1 | 6/2017 |
| EP | 3184745 | A1 | 6/2017 |
| EP | 3284908 | A2 | 2/2018 |

* cited by examiner

AIRFOIL TURN CAPS IN GAS TURBINE ENGINES

STATEMENT REGARDING FEDERALLY SPONSORED RESEARCH OR DEVELOPMENT

This invention was made with government support under Contract No. FA8650-09-D-2923-0021 awarded by the U.S. Air Force. The government has certain rights in the invention.

BACKGROUND

The subject matter disclosed herein generally relates to cooling flow in airfoils of gas turbine engines and, more particularly, to airfoil turn caps for cooling flow gaspaths within airfoils in gas turbine engines.

In gas turbine engines, cooling air may be configured to flow through an internal cavity of an airfoil to prevent overheating. Gas temperature profiles are usually hotter at the outer diameter than at the inner diameter of the airfoils. In order to utilize cooling flow efficiently and minimize heat pickup and pressure loss, the cross-sectional area of the internal cooling flow may be configured to vary so that Mach numbers remain low where heat transfer is not needed (typically the inner diameter) and high Mach numbers where heat transfer is needed (typically the outer diameter). To do this in a casting, the walls of the airfoils tend to be thick in some areas and thin in other areas, which may add weight to the engine in which the airfoils are employed. Previously, baffles have been used to occupy some of the space within the internal cavity of the airfoils. The baffles extend from one end of the cavity all the way through the other end of the cavity within the airfoil. This configuration may result in relatively high Mach numbers to provide cooling throughout the cavity. Further, such configuration may provide high heat transfer, and pressure loss throughout the cavity.

In order to achieve metal temperatures required to meet full life with the cooling flow allocated, the space-eater baffles are required to be used inside an airfoil serpentine cooling passage. The serpentine turns are typically located outside gaspath endwalls to allow the space-eater baffles to extend all the way to the gaspath endwall (e.g., extend out of the cavity of the airfoil). However, because the airfoil may be bowed, the turn walls must also follow the arc of the bow to provide clearance for the space-eater baffles to be inserted. During manufacture, because the wax die end blocks do not have the same pull direction as the bow of the airfoil, the turn walls cannot be cast without creating a die-lock situation and trapping the wax die.

Thus it is desirable to provide means of controlling the heat transfer and pressure loss in airfoils of gas turbine engines, particularly at the endwall turn for serpentine gaspaths.

SUMMARY

According to some embodiments, airfoils of a gas turbine engines are provided. The airfoils include a hollow body defining a first airfoil cavity and a second airfoil cavity, the hollow body having an inner diameter end and an outer diameter end, a first airfoil platform at one of the inner diameter end and the outer diameter end of the hollow body, the first airfoil platform having a gaspath surface and a non-gaspath surface, wherein the hollow body extends from the gaspath surface, a first cavity opening formed in the non-gaspath surface of the first airfoil platform fluidly connected to the first airfoil cavity, a second cavity opening formed in the non-gaspath surface of the first airfoil platform fluidly connected to the second airfoil cavity, and a first turn cap fixedly attached to the first airfoil platform on the non-gaspath surface covering the first cavity opening of the first airfoil platform and the second cavity opening of the first airfoil platform and defining a first turning cavity such that the first cavity opening of the first airfoil platform is fluidly connected to the second cavity opening of the first airfoil platform by the first turning cavity.

In addition to one or more of the features described herein, or as an alternative, further embodiments of the airfoil may include that the hollow body is a curved body that forms a bowed vane.

In addition to one or more of the features described herein, or as an alternative, further embodiments of the airfoil may include a first baffle positioned within the first airfoil cavity.

In addition to one or more of the features described herein, or as an alternative, further embodiments of the airfoil may include a second baffle positioned within the second airfoil cavity.

In addition to one or more of the features described herein, or as an alternative, further embodiments of the airfoil may include a second airfoil platform at the other of the inner diameter end and the outer diameter end, the second airfoil platform having a gaspath surface facing the gaspath surface of the first airfoil platform, and a non-gaspath surface, the airfoil body extending between the first and second airfoil platforms.

In addition to one or more of the features described herein, or as an alternative, further embodiments of the airfoil may include a first cavity opening formed in the non-gaspath surface of the second airfoil platform fluidly connected to the second airfoil cavity and a second cavity opening formed in the non-gaspath surface of the second airfoil platform and fluidly connected to a third airfoil cavity of the hollow body.

In addition to one or more of the features described herein, or as an alternative, further embodiments of the airfoil may include a second turn cap fixedly attached to the second airfoil platform on the non-gaspath surface covering the first cavity opening of the second airfoil platform and the second cavity opening of the second airfoil platform such that the first cavity opening of the second airfoil platform is fluidly connected to the second cavity opening of the second airfoil platform and the second airfoil cavity is fluidly connected to the third airfoil cavity.

In addition to one or more of the features described herein, or as an alternative, further embodiments of the airfoil may include that the first turn cap comprises a peripheral edge configured to contact the non-gaspath surface of the first airfoil platform.

In addition to one or more of the features described herein, or as an alternative, further embodiments of the airfoil may include that the first turn cap is welded or brazed to the non-gaspath surface of the first airfoil platform along the peripheral edge.

In addition to one or more of the features described herein, or as an alternative, further embodiments of the airfoil may include that the first airfoil cavity and the second airfoil cavity form one up pass and one down pass of a serpentine cavity within the hollow body.

According to other embodiments, methods of manufacturing airfoils are provided. The methods include forming a hollow body defining a first airfoil cavity and a second airfoil cavity, the hollow body having an inner diameter end and an outer diameter end, forming a first airfoil platform at one of the inner diameter end and the outer diameter end of the hollow body, the first airfoil platform having a gaspath surface and a non-gaspath surface, wherein the hollow body extends from the gaspath surface, forming a first cavity opening in the non-gaspath surface of the first airfoil platform fluidly connecting to the first airfoil cavity, forming a second cavity opening formed in the non-gaspath surface of the first airfoil platform fluidly connecting to the second airfoil cavity, forming a first turn cap separately from the hollow body and the first airfoil platform, and fixedly attaching the first turn cap to the first airfoil platform on the non-gaspath surface covering the first cavity opening of the first airfoil platform and the second cavity opening of the first airfoil platform and defining a first turning cavity such that the first cavity opening of the first airfoil platform is fluidly connected to the second cavity opening of the first airfoil platform and the first airfoil cavity is fluidly connected to the second airfoil cavity by the first turning cavity.

In addition to one or more of the features described herein, or as an alternative, further embodiments of the method may include that the hollow body is a curved body that forms a bowed vane.

In addition to one or more of the features described herein, or as an alternative, further embodiments of the method may include installing a first baffle within the first airfoil cavity.

In addition to one or more of the features described herein, or as an alternative, further embodiments of the method may include installing a second baffle within the second airfoil cavity.

In addition to one or more of the features described herein, or as an alternative, further embodiments of the method may include forming a second airfoil platform at the other of the inner diameter end and the outer diameter end, the second airfoil platform having a gaspath surface facing the gaspath surface of the first airfoil platform, and a non-gaspath surface, the airfoil body extending between the first and second airfoil platforms.

In addition to one or more of the features described herein, or as an alternative, further embodiments of the method may include forming a first cavity opening in the non-gaspath surface of the second airfoil platform fluidly connecting to the second airfoil cavity and forming a second cavity opening in the non-gaspath surface of the second airfoil platform fluidly connecting to a third airfoil cavity in the hollow body.

In addition to one or more of the features described herein, or as an alternative, further embodiments of the method may include forming a second turn cap separately from the hollow body and the first airfoil platform and fixedly attaching the second turn cap to the second airfoil platform on the non-gaspath surface defining a second turning cavity, the second turn cap covering the first cavity opening of the second airfoil platform and the second cavity opening of the second airfoil platform such that the first cavity opening of the second airfoil platform is fluidly connected to the second cavity opening of the second airfoil platform and the second airfoil cavity is fluidly connected to the third airfoil cavity by the second turning cavity.

In addition to one or more of the features described herein, or as an alternative, further embodiments of the method may include that the first turn cap comprises a peripheral edge configured to contact the non-gasp ath surface of the first airfoil platform.

In addition to one or more of the features described herein, or as an alternative, further embodiments of the method may include that the fixed attachment of the first turn cap is by welding or brazing to the non-gaspath surface of the first airfoil platform along the peripheral edge.

In addition to one or more of the features described herein, or as an alternative, further embodiments of the method may include that the first airfoil cavity and the second airfoil cavity form one up pass and one down pass of a serpentine cavity within the hollow body.

Technical effects of embodiments of the present disclosure include turn caps to be installed to platforms of airfoil to provide turning cavities to improve cooling airfoil within airfoil bodies.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
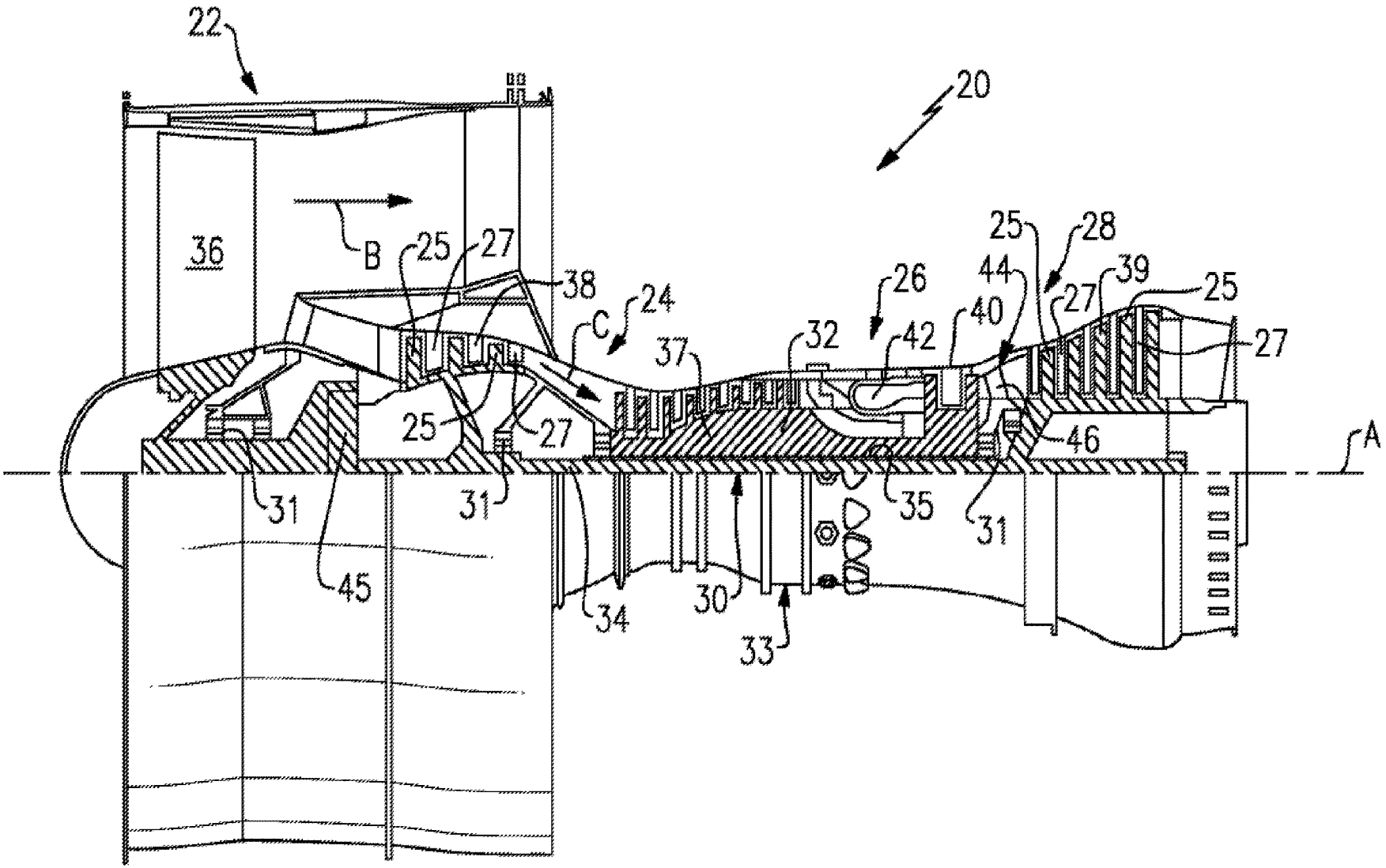
FIG. 1A is a schematic cross-sectional view of a gas turbine engine that may employ various embodiments disclosed herein.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 1B:
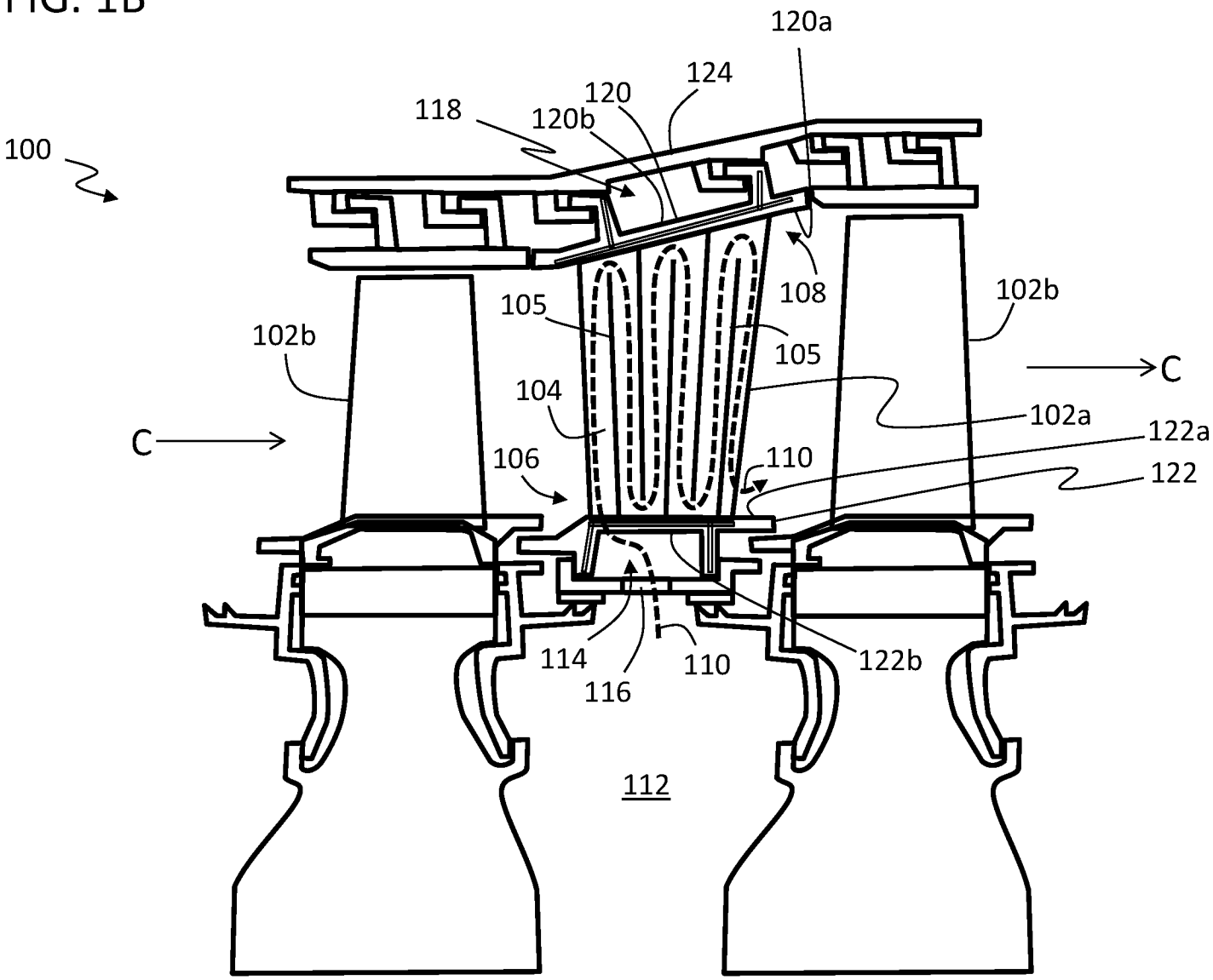
FIG. 1B is a partial schematic view of a turbine section of the gas turbine engine of FIG. 1A.

FIG. 1B is a partial schematic view of a turbine section 100 that may be part of the gas turbine engine 20 shown in FIG. 1A. Turbine section 100 includes one or more airfoils 102*a*, 102*b*. As shown, some airfoils 102*a* are stationary stator vanes and other airfoils 102*b* are blades of turbines disks. The airfoils 102*a*, 102*b* are hollow body airfoils with one or more internal cavities defining a number of gaspath channels 104 (schematically shown in vane 102*a*). The airfoil cavities 104 are formed within the airfoils 102*a*, 102*b* and extend from an inner diameter 106 to an outer diameter 108, or vice-versa. The airfoil cavities 104, as shown in the vane 102*a*, are separated by partitions 105 that extend either from the inner diameter 106 or the outer diameter 108 of the vane 102*a*. The partitions 105, as shown, extend for a portion of the length of the vane 102*a* to form a serpentine gaspath within the vane 102*a*. As such, the partitions 105 may stop or end prior to forming a complete wall within the vane 102*a*. Thus, each of the airfoil cavities 104 may be fluidly connected. In other configurations, the partitions 105 can extend the full length of the respective airfoil. Although not shown, those of skill in the art will appreciate that the blades 102*b* can include similar cooling gaspaths formed by partitions therein.

As shown, counting from a leading edge on the left, the vane 102*a* may include six airfoil cavities 104 within the hollow body: a first airfoil cavity on the far left followed by a second airfoil cavity immediately to the right of the first airfoil cavity and fluidly connected thereto, and so on. Those of skill in the art will appreciate that the partitions 105 that separate and define the airfoil cavities 104 are not usually visible and FIG. 1B is merely presented for illustrative and explanatory purposes.

The airfoil cavities 104 may be configured to have air flow therethrough to cool the vane 102*a*. For example, as shown in FIG. 1B, an airflow path 110 is indicated by a dashed line.

In the configuration of FIG. 1B, air flows from a rotor cavity 112 and into an airfoil inner diameter cavity 114 through an orifice 116. The air then flows into and through the airfoil cavities 104 as indicated by the airflow path 110. Positioned at the outer diameter of the airfoil 102, as shown, is an outer diameter cavity 118.

As shown in FIG. 1B, the vane 102*a* includes an outer diameter platform 120 and an inner diameter platform 122. The vane platforms 120, 122 are configured to enable attachment within and to the gas turbine engine. For example, as appreciated by those of skill in the art, the inner diameter platform 122 can be mounted between adjacent rotor disks and the outer diameter platform 120 can be mounted to a case 124 of the gas turbine engine. As shown, the outer diameter cavity 118 is formed between the case 124 and the outer diameter platform 120. Those of skill in the art will appreciate that the outer diameter cavity 118 and the inner diameter cavity 114 are outside of or separate from the core flow path C. The cavities 114, 118 are separated from the core flow path C by the platforms 120, 122. Thus, each platform 120, 122 includes a respective core gaspath surface 120*a*, 122*a* and a non-gaspath surface 120*b*, 122*b*. The body of the vane 102*a* extends from and between the gaspath surfaces 120*a*, 122*a* of the respective platforms 120, 122. In some embodiments, the platforms 120, 122 and the body of the vane 102*a* are a unitary body.

Air is passed through the airfoil cavities of the airfoils to provide cooling airflow to prevent overheating of the airfoils and/or other components or parts of the gas turbine engine. The flow rate through the airfoil cavities may be a relatively low flow rate of air and because of the low flow rate the cooling may be too low to achieve the desired metal temperatures of the airfoils. One solution to this is to add one or more baffles into the airfoil cavities.

That is, in order to achieve desired metal temperatures to meet airfoil full-life with the cooling flow allocated based on turbine engine design, space-eater baffles have been required to be used inside airfoil serpentine cooling passages (e.g., within the airfoil cavities 104 shown in FIG. 1B). In some of these configurations, the serpentine turns must be located outside the gaspath endwalls (e.g., outside of the airfoil body) to allow the space-eater baffles to extend all the way to the gaspath endwall. That is, the space-eater baffles may be required to extend into the outer diameter cavity 118 or the inner diameter cavity 114. However, because the vane 102*a* may be bowed, the turn walls must also follow the arc of the bow to provide clearance for the space-eater baffles to be inserted. However, during manufacturing, because the wax die end blocks do not have the same pull direction as the bow, the turn walls cannot be cast without creating a die-lock situation and trapping the wax die.

Figure 2B:
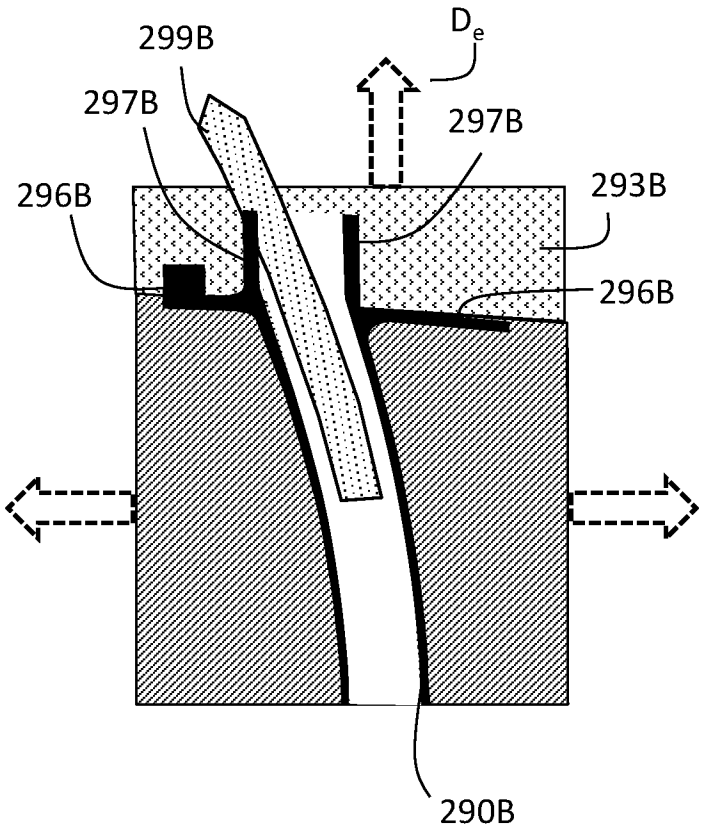
FIG. 2B is a schematic illustration of an alternative process for forming an airfoil.
Figure 2A:
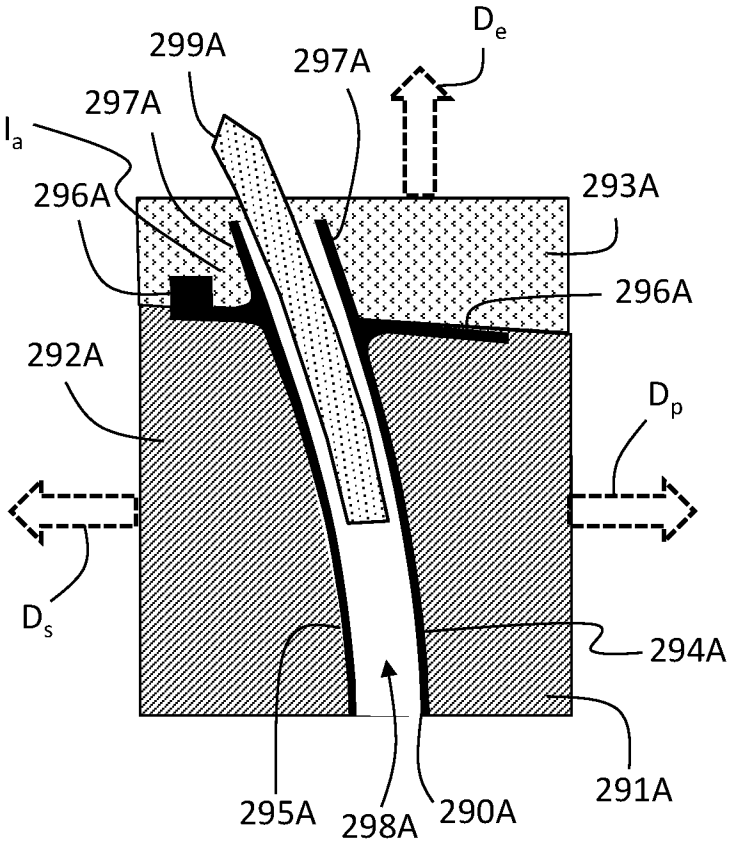
FIG. 2A is a schematic illustration of a manufacturing process for forming an airfoil.

For example, referring now to FIGS. 2A and 2B, various manufacturing difficulties are illustratively shown with respect to forming airfoils. In FIG. 2A the form and structure of the platform is shown causing an issue related to die removal and FIG. 2B illustrates an issue related to a platform structure and form that allows for die removal but causes a problem with baffle installation. In FIG. 2A, an airfoil 290A, such as a vane, is being manufactured using an airfoil pressure side wax die 291A, an airfoil suction side wax die 292A, and an end block wax die 293A. Directional arrows are illustratively shown to indicate the direction in which the respective wax die 291A, 292A, 293A is removed during the manufacturing process. For example, pressure side pull direction $D_p$ is shown to the right in FIG. 2A, suction side pull direction $D_s$ is shown to the left in FIG. 2A, and end block pull direction $D_e$ is shown in an upward direction in FIG. 2A.

The airfoil 290A includes a pressure side wall 294A, a suction side wall 295A, and a platform 296A (in this case an outer diameter platform). The side walls 294A, 295A extend through the platform 296A and form turn walls 297A. The turn walls are designed to allow for air flowing through an airfoil cavity 298A to turn from one airfoil cavity to another (e.g., between adjacent up and down passes of a serpentine cavity). A baffle 299A is illustrated inserted into the airfoil 290A to provide cooling properties as described above. Once the baffle 299A is installed and the dies 291A, 292A, 293A are removed, the turn walls 297A can be capped with a cap that is welded or otherwise attached to the turn walls 297A, as known in the art.

As shown in FIG. 2A, the structure of the platform 296A interferes with the removal of the end block wax die 293A. Specifically, as shown, the turn walls 297A of the platform 296A are designed to prevent the baffle 299A from hitting the turn walls 297A. The turn walls 297A are integrally formed with the platform 296A.

However, because the turn walls 297A follow the curvature of the side walls 294A, 295A of the airfoil 290A, the end block wax die 293A will be prevented from pulling in the end block pull direction $D_e$ because of interference $I_a$. To properly remove the end block wax die 293A, the pull direction would be up and to the left in FIG. 2A, not directly upward as is required for proper removable and preventing die lock. That is, because of the interference $I_a$ formed by the turn walls 297A and the material of the end block wax die 293A that formed therein, the end block wax die 293A cannot be properly removed during manufacturing.

To account for this, the turn walls can be adjusted to allow for proper directional pull of the end block wax die. For example, as shown in FIG. 2B, an airfoil 290B is formed with turn walls 297B of the platform 296B that are arranged for proper removable of an end block wax die 293B in the end block pull direction $D_e$. However, as illustratively shown, the turn walls 297B will now interfere with the insertion of the baffle 299B.

Because of the above issues, various prior work-arounds have been proposed. For example, the airfoils can be non-bowed, which may not be preferable in certain turbine section designs. However, it may be advantageous to have bowed airfoils. In some configurations, the baffles can be configured to extend through the turn in the gas path, such that they stop at the airfoil platform. In such a case, heat transfer can be high along the entire airfoil cavity surface to the gaspath endwall. However, in such a case, the baffles will have a gap formed therebetween with respect to two adjacent airfoil cavities (e.g., up and down paths) and such gaps between baffles can cause high pressure losses. In another design, the baffles can be shortened such that they stop short of a turn in a gaspath. However, because of the turn that would be formed at the exterior diameter (e.g., outer diameter of the airfoil), this can result in low heat transfer. Accordingly, improved solutions for manufacturing airfoils having baffles within serpentine cavities may be advantageous.

Accordingly, as provided herein, serpentine turn caps are formed as a separate piece and joined to the airfoil platform casting after the space-eater baffles are inserted. Such serpentine turn caps, as provided herein, may be cast, additively manufactured, formed from sheet metal, or manufactured by other means. As provided herein, by creating the turn as a separate piece, the end of the airfoil cavities are exposed, allowing insertion of the space-eater baffles. Moreover, creating the turn as a separate piece allows the wax die to be removed during the casting process without die-lock.

Figure 3:
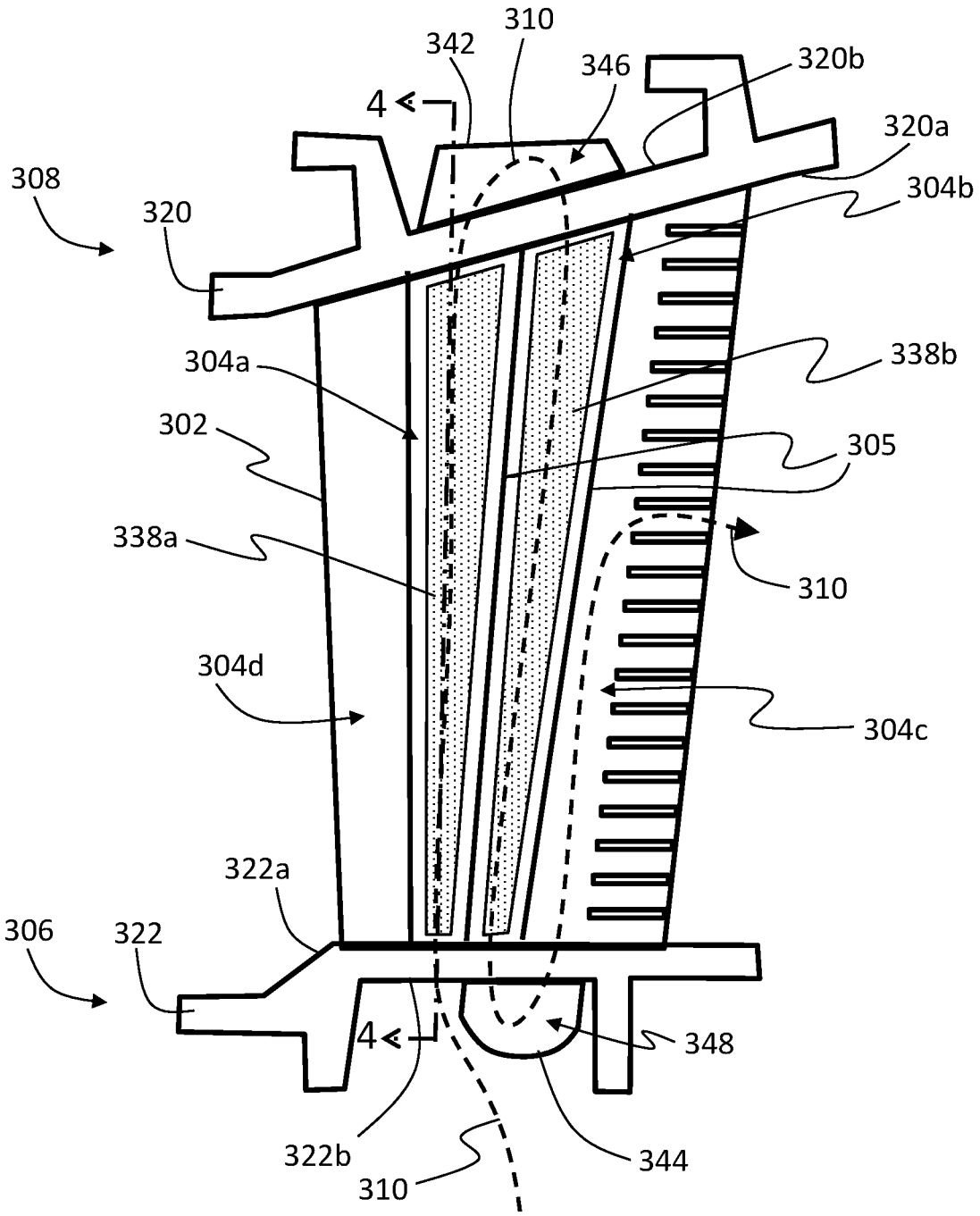
FIG. 3 is a schematic illustration of an airfoil configured in accordance with a non-limiting embodiment of the present disclosure.

Turning now to FIG. 3, a schematic illustration of an airfoil 302 configured in accordance with an embodiment of the present disclosure is shown. The airfoil 302 may be a vane and similar to that shown and described above having a body that extends from an inner diameter platform 322 to an outer diameter platform 320. The airfoil 302 extends from a gaspath surface 320*a* of the outer diameter platform 320 to a gaspath surface 322*a* of the inner diameter platform 322.

The airfoil 302 includes a plurality of interior airfoil cavities, with a first airfoil cavity 304*a* being an up pass of a serpentine cavity, a second airfoil cavity 304*b* being a down pass of the serpentine cavity, and a third airfoil cavity 304*c* being a trailing edge cavity. The airfoil 302 also includes a fourth airfoil cavity 304*d* that is a leading edge cavity. As illustratively shown, a cooling flow of air can follow an airflow path 310 by entering the airfoil 302 from the inner diameter, flowing upward to the outer diameter through the up pass of the first airfoil cavity 304*a,* turning at the outer diameter, downward through the down pass of the second airfoil cavity 304*b,* turning at the inner diameter, and then upward and out through the third airfoil cavity 304*c*. As shown, the first and second airfoil cavities 304*a,* 304*b* are configured with baffles 338*a,* 338*b* inserted therein.

To provide sufficient cooling flow and control of air pressure within the airflow path 310, the airfoil 302 is provided with a first turn cap 342 and a second turn cap 344. The first turn cap 342 defines a first turning cavity 346 therein. Similarly, the second turn cap 344 defines a second turning cavity 348 therein. As illustratively shown, the first turn cap 342 is positioned at an outer diameter 308 of the airfoil 302 and fluidly connects the first airfoil cavity 304*a* with the second airfoil cavity 304*b*. The second turn cap 344 is positioned at an inner diameter 306 of the airfoil 302 and fluidly connects the second airfoil cavity 304*b* with the third airfoil cavity 304*c*. The first and second turning cavities 346, 348 define portions of the airflow path 310 used for cooling the airfoil 302. The turn caps 342, 344 are attached to respective non-gaspath surfaces 320*b,* 322*b* of the platforms 320, 322.

The first and second turn caps 342, 344 move the turn of the airflow path 310 outside of the airfoil and into the cavities external to the airfoil (e.g., outer diameter cavity 118 and inner diameter cavity 114 shown in FIG. 1B). As such, a low heat transfer region is outside of the gaspath and the baffles 338*a,* 338*b* can provide for high heat transfer along the entire cavity surface within the body of the airfoil 302. The turn caps 342, 344 are manufactured as separate parts or pieces that are welded or otherwise attached to the platforms 320, 322.

As shown illustratively, the first turn cap 342 and the second turn cap 344 have different geometric shapes. The turn caps in accordance with the present disclosure can take various different geometric shapes such that a desired air flow can be achieved. For example, a curved turn cap may provide improved and/or controlled airflow at the turn outside of the airfoil body. Other geometries may be employed, for example, to accommodate other considerations within the gas turbine engine, such as fitting between the platform and a case of the engine. Further, various manufacturing considerations may impact turn cap shape. For example, flat surfaces are easier to fabricate using sheet metal, and thus it may be cost effective to have flat surfaces of the turn caps, while still providing sufficient flow control.

Figure 4A:
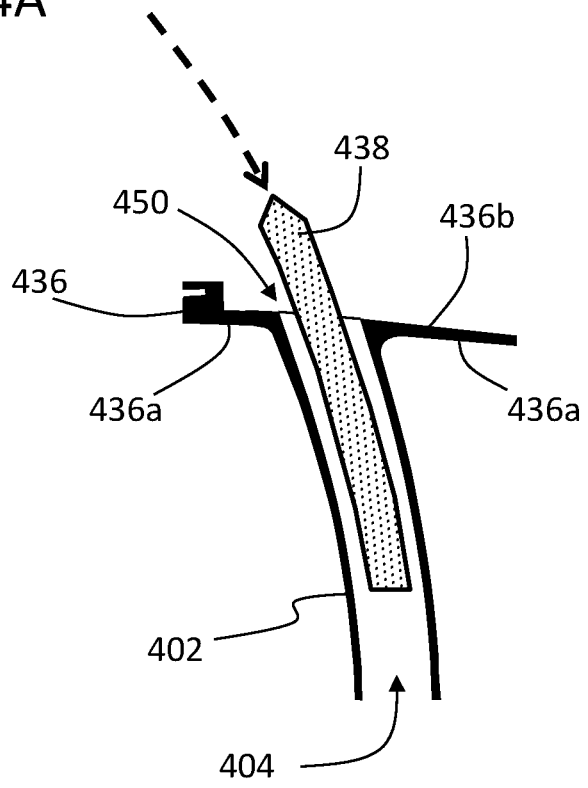
FIG. 4A is a partial schematic illustration of an airfoil configured in accordance with a non-limiting embodiment of the present disclosure viewed along the line 4-4 of FIG. 3, illustrating installation of a baffle.
Figure 4B:
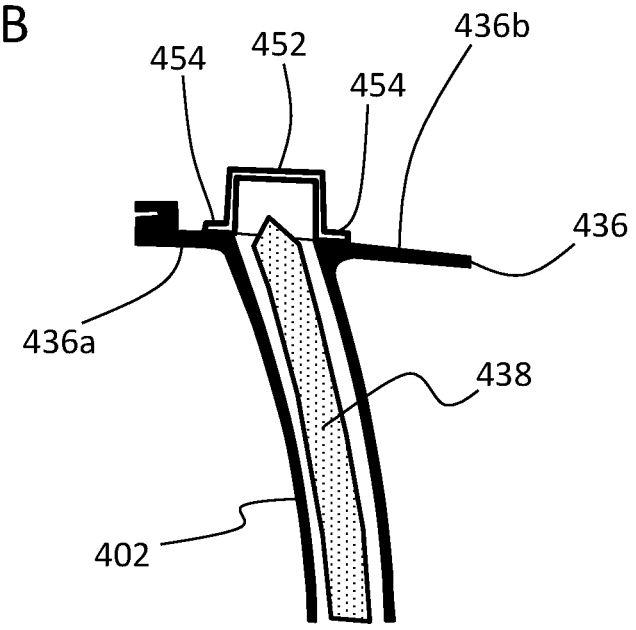
FIG. 4B is a second schematic illustration of the airfoil of FIG. 4A with the baffle installed and a turn cap applied to the airfoil.

Turning now to FIGS. 4A-4B, schematic illustrations of a manufacturing process in accordance with embodiments of the present disclosure are shown. The schematic illustrations of FIGS. 4A-4B are along the line 4-4 shown in FIG. 3. In FIG. 4A, an airfoil 402 is formed using dies similar to that shown and described above with respect to FIGS. 2A-2B (e.g., an airfoil pressure side wax die, an airfoil suction side wax die, and an end block wax die). The primary difference between the airfoil 402 of FIGS. 4A-4B and that shown in prior embodiments is that no turn walls (e.g., turn walls 297*a,* 297*b* of FIGS. 2A-2B) are provided extending from a non-gaspath surface 436*b* of a platform 436 of the airfoil 402. The platform 436 defines the non-gaspath surface 436*b* and a gaspath surface 436*a,* as shown. A cavity opening 450 is formed in the platform 436 of the airfoil 402 that provides an opening from the gaspath surface 436*a* to the non-gaspath surface 436*b*.

By eliminating the turn walls from the construction of the platform 436, a baffle 438 can be easily inserted through the cavity opening 450 and into an airfoil cavity 404 of the airfoil 402 without obstruction. Further, the end block wax die can be removed without die lock. Thus, after the baffle 438 is inserted into an airfoil cavity 404 of the airfoil 402, a turn cap 452 is attached to a non-gaspath surface 436*b* of the platform 436, as shown in FIG. 4B. The turn cap 452 is fitted over the openings of at least two adjacent airfoil cavities such that fluid flow can pass from a first airfoil cavity, into the turn cap, and then be directed into a second airfoil cavity. The turn cap 452 can be attached around a peripheral edge 454 of the turn cap 452 to the platform 436 of the airfoil 402. The attachment of the turn cap 452 can be by welding, brazing, or other attachment means.

Figure 5:
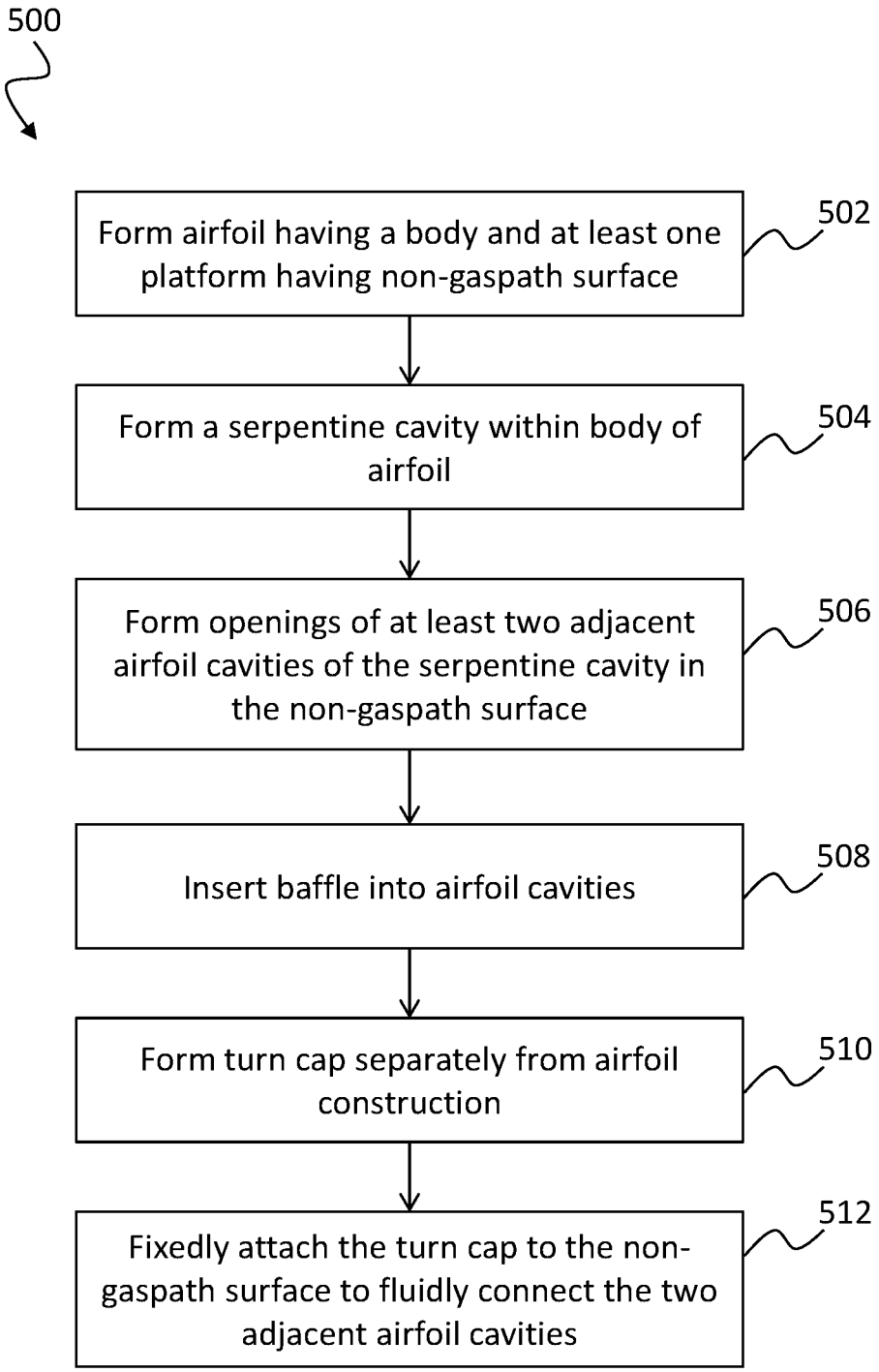
FIG. 5 is a flow process for manufacturing an airfoil having turn caps in accordance with a non-limiting embodiment of the present disclosure.

Turning now to FIG. 5, a flow process 500 for manufacturing an airfoil in accordance with a non-limiting embodiment of the present disclosure is shown. The flow process 500 can be employed to manufacture airfoils as shown and described above.

At block 502, an airfoil is formed having a body and at least one platform. The airfoil can be formed with two platforms (e.g., as shown and described above). The platform is formed with a non-gaspath surface. Further, those of skill in the art will appreciate that the platform is formed with a core gaspath surface, such as shown and described above.

At block 504, a serpentine cavity is formed within the body of the airfoil. The serpentine cavity includes at least two airfoil cavities. For example, the serpentine cavity can include at least one up pass airfoil cavity and at least one down pass airfoil cavity that are adjacent each other. Additional airfoil cavities, as part of the serpentine cavity or separate therefrom, can be formed within the airfoil body.

At block 506, cavity openings of the at least two airfoil cavities are formed in the non-gaspath surface of the platform to form fluid paths through the platform from a non-gaspath side to the interior of the airfoil cavities.

Those of skill in the art will appreciate that blocks 502-506 can be performed substantially simultaneously depending on the particular manufacturing technique to form the airfoil.

At block 508, at least one baffle is inserted into at least one of the airfoil cavities. In some configurations a baffle will be inserted into each of the airfoil cavities (e.g., as shown in FIG. 3).

At block 510, a turn cap is formed separately from the airfoil. Although shown sequentially after airfoil formation, those of skill in the art will appreciate that the turn cap can be formed at any time and completely independently from formation of the airfoil body (e.g., blocks 502-508). The turn cap is formed to be able to be attached to the airfoil and to cover the openings formed at block 506. That is, the turn cap is manufactured to provide a fluid connection between the first and second airfoil cavities such that an airflow passing through the first airfoil cavity will be turned to flow into the second airfoil cavity by the turn cap. The turn cap can be formed from sheet metal, can be cast, forged, additively manufactured, or otherwise formed.

At block 512, the turn cap is fixedly attached to the non-gaspath surface of the platform to fluidly connect the first and second airfoil cavities. The attachment can be by welding, brazing, or other attachment means.

The above process, or portions thereof, can be repeated for attaching multiple turn caps to the non-gaspath surface(s) of platform(s) of the airfoil. Further, turn caps can be installed at both inner and outer diameter platforms of the airfoil. In some such configurations, the turn caps can be arranged to provide for a continuous serpentine flow path through the airfoil body. Further, although described with respect to a serpentine flow path, those of skill in the art will appreciate that turn caps in accordance with the present disclosure can be used to fluidly connect two or more of any type of cavity within an airfoil.

Although various embodiments have been shown and described herein regarding turn caps for airfoils, those of skill in the art will appreciate that various combinations of the above embodiments, and/or variations thereon, may be made without departing from the scope of the invention. For example, a single airfoil may be configured with more than one turn cap with each turn cap connecting two or more adjacent airfoil cavities.

Advantageously, embodiments described herein provide turn caps that are fixedly attached to non-gaspath surfaces of airfoil platforms to fluidly connect two adjacent airfoil cavities of the airfoil. Such turn caps can be used with serpentine flow paths within airfoils such that an up pass and a down pass of the serpentine cavity can be fluidly connected in external cavities outside of the core flow path of the gas turbine engine. Advantageously, such turn caps allow for installation of space-eater baffles into curved airfoils, such as bowed vanes, without interference with manufacturing requirements. Moreover, with respect to manufacturing, such inclusion of separate turn caps, wax dies can be used and removed without die lock.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although shown with bowed vanes, those of skill in the art will appreciate that airfoils manufactured in accordance with the present disclosure are not so limited. That is, any airfoil where it is desired to have a turn path formed exterior to an airfoil body can employ embodiments described herein.

Accordingly, the present disclosure is not to be seen as limited by the foregoing description, but is only limited by the scope of the appended claims.

What is claimed is:

1. An airfoil of a gas turbine engine comprising:

a hollow body defining a first airfoil cavity and a second airfoil cavity, the hollow body having an inner diameter end and an outer diameter end;

a first airfoil platform at one of the inner diameter end and the outer diameter end of the hollow body, the first airfoil platform having a gaspath surface and a non-gaspath surface, wherein the hollow body extends from the gaspath surface;

a first cavity opening formed in the non-gaspath surface of the first airfoil platform fluidly connected to the first airfoil cavity;

a second cavity opening formed in the non-gaspath surface of the first airfoil platform fluidly connected to the second airfoil cavity;

a first turn cap fixedly attached to the first airfoil platform on the non-gaspath surface covering the first cavity opening of the first airfoil platform and the second cavity opening of the first airfoil platform and defining a first turning cavity such that the first cavity opening of the first airfoil platform is fluidly connected to the second cavity opening of the first airfoil platform by the first turning cavity; and a first baffle positioned within the first airfoil cavity.

2. The airfoil of claim 1, wherein the hollow body is a curved body that forms a bowed vane.

3. The airfoil of claim 1, further comprising a second baffle positioned within the second airfoil cavity.

4. The airfoil of claim 1, further comprising a second airfoil platform at the other of the inner diameter end and the outer diameter end, the second airfoil platform having a gaspath surface facing the gaspath surface of the first airfoil platform, and a non-gaspath surface, the airfoil body extending between the first and second airfoil platforms.

5. The airfoil of claim 4, further comprising a first cavity opening formed in the non-gaspath surface of the second airfoil platform fluidly connected to the second airfoil cavity and a second cavity opening formed in the non-gaspath surface of the second airfoil platform and fluidly connected to a third airfoil cavity of the hollow body.

6. The airfoil of claim 5, further comprising a second turn cap fixedly attached to the second airfoil platform on the non-gaspath surface covering the first cavity opening of the second airfoil platform and the second cavity opening of the second airfoil platform such that the first cavity opening of the second airfoil platform is fluidly connected to the second cavity opening of the second airfoil platform and the second airfoil cavity is fluidly connected to the third airfoil cavity.

7. The airfoil of claim 1, wherein the first turn cap comprises a peripheral edge configured to contact the non-gaspath surface of the first airfoil platform.

8. The airfoil of claim 7, wherein the first turn cap is welded or brazed to the non-gaspath surface of the first airfoil platform along the peripheral edge.

9. The airfoil of claim 1, wherein the first airfoil cavity and the second airfoil cavity form one up pass and one down pass of a serpentine cavity within the hollow body.

10. A method of manufacturing an airfoil, the method comprising:

forming a hollow body defining a first airfoil cavity and a second airfoil cavity, the hollow body having an inner diameter end and an outer diameter end;

forming a first airfoil platform at one of the inner diameter end and the outer diameter end of the hollow body, the first airfoil platform having a gaspath surface and a non-gaspath surface, wherein the hollow body extends from the gaspath surface;

forming a first cavity opening in the non-gaspath surface of the first airfoil platform fluidly connecting to the first airfoil cavity;

forming a second cavity opening formed in the non-gaspath surface of the first airfoil platform fluidly connecting to the second airfoil cavity;

forming a first turn cap separately from the hollow body and the first airfoil platform;

fixedly attaching the first turn cap to the first airfoil platform on the non-gaspath surface covering the first cavity opening of the first airfoil platform and the second cavity opening of the first airfoil platform and defining a first turning cavity such that the first cavity opening of the first airfoil platform is fluidly connected to the second cavity opening of the first airfoil platform and the first airfoil cavity is fluidly connected to the second airfoil cavity by the first turning cavity; and installing a first baffle within the first airfoil cavity.

11. The method of claim 10, wherein the hollow body is a curved body that forms a bowed vane.

12. The method of claim 10, further comprising installing a second baffle within the second airfoil cavity.

13. The method of claim 10, further comprising forming a second airfoil platform at the other of the inner diameter end and the outer diameter end, the second airfoil platform having a gaspath surface facing the gaspath surface of the first airfoil platform, and a non-gaspath surface, the airfoil body extending between the first and second airfoil platforms.

14. The method of claim 13, further comprising:

forming a first cavity opening in the non-gaspath surface of the second airfoil platform fluidly connecting to the second airfoil cavity; and forming a second cavity opening in the non-gaspath surface of the second airfoil platform fluidly connecting to a third airfoil cavity in the hollow body.

15. The method of claim 14, further comprising:

forming a second turn cap separately from the hollow body and the first airfoil platform; and fixedly attaching the second turn cap to the second airfoil platform on the non-gaspath surface defining a second turning cavity, the second turn cap covering the first cavity opening of the second airfoil platform and the second cavity opening of the second airfoil platform such that the first cavity opening of the second airfoil platform is fluidly connected to the second cavity opening of the second airfoil platform and the second airfoil cavity is fluidly connected to the third airfoil cavity by the second turning cavity.

16. The method of claim 10, wherein the first turn cap comprises a peripheral edge configured to contact the non-gaspath surface of the first airfoil platform.

17. The method of claim 16, wherein the fixed attachment of the first turn cap is by welding or brazing to the non-gaspath surface of the first airfoil platform along the peripheral edge.

18. The method of claim 10, wherein the first airfoil cavity and the second airfoil cavity form one up pass and one down pass of a serpentine cavity within the hollow body.

19. An airfoil of a gas turbine engine comprising:

a hollow body defining a first airfoil cavity and a second airfoil cavity, the hollow body having an inner diameter end and an outer diameter end;

a first airfoil platform at one of the inner diameter end and the outer diameter end of the hollow body, the first airfoil platform having a gaspath surface and a non-gaspath surface, wherein the hollow body extends from the gaspath surface;

a first cavity opening formed in the non-gaspath surface of the first airfoil platform fluidly connected to the first airfoil cavity;

a second cavity opening formed in the non-gaspath surface of the first airfoil platform fluidly connected to the second airfoil cavity;

a first turn cap fixedly attached to the first airfoil platform on the non-gaspath surface covering the first cavity opening of the first airfoil platform and the second cavity opening of the first airfoil platform and defining a first turning cavity such that the first cavity opening of the first airfoil platform is fluidly connected to the second cavity opening of the first airfoil platform by the first turning cavity, wherein the hollow body is a curved body that forms a bowed vane.

20. The airfoil of claim 19, further comprising a second airfoil platform at the other of the inner diameter end and the outer diameter end, the second airfoil platform having a gaspath surface facing the gaspath surface of the first airfoil platform, and a non-gaspath surface, the airfoil body extending between the first and second airfoil platforms.

* * * * *